US006708537B1

(12) United States Patent
Eschweiler et al.

(10) Patent No.: US 6,708,537 B1
(45) Date of Patent: Mar. 23, 2004

(54) DOOR LOCK ASSEMBLY WITH FREE FLOATING PADDLE

(75) Inventors: Kevin Paul Eschweiler, New Hampton, IA (US); Marvin Lee Larsen, New Hampton, IA (US); Barbara Jolene Pickar, New Hampton, IA (US); Chad A. Uhlenhake, Ossian, IA (US); Jennifer Lynn Bearman, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 10/267,458

(22) Filed: Oct. 9, 2002

(51) Int. Cl.[7] ..... E05B 13/10

(52) U.S. Cl. ..... 70/208; 292/DIG. 27; 292/DIG. 31

(58) Field of Search ..... 70/208, 209, 218; 292/DIG. 27, DIG. 31, DIG. 25

(56) References Cited

U.S. PATENT DOCUMENTS 4,838,056 A * 6/1989 Weinerman et al. ..... 70/208
4,951,486 A * 8/1990 Braun et al. ..... 70/208
5,127,686 A 7/1992 Gleason et al.
5,174,619 A 12/1992 Bender et al.
5,263,346 A * 11/1993 Sato et al. ..... 70/210
5,439,260 A * 8/1995 Weinerman et al. ..... 292/48
5,564,295 A * 10/1996 Weinerman et al. ..... 70/208
5,586,458 A * 12/1996 Weinerman et al. ..... 70/208
5,820,175 A * 10/1998 Clavin ..... 292/165
5,852,943 A * 12/1998 Dutka et al. ..... 70/237
5,927,772 A * 7/1999 Antonucci et al. ..... 292/336.3
5,941,104 A 8/1999 Sadler
6,523,869 B1 * 2/2003 Jensen et al. ..... 292/336.3
6,543,821 B1 * 4/2003 Weinerman et al. ..... 292/123

* cited by examiner

*Primary Examiner*—John B. Walsh
(74) *Attorney, Agent, or Firm*—McKee, Voorhees & Sease, P.L.C.

(57) ABSTRACT

A door lock assembly is provided for use on multiple types of door latches. The assembly includes a housing, a paddle pivotally mounted on the housing, and a pivot plate pivotally mounted on the housing and operatively connected to the door latch. An actuator is mounted on the housing and is operatively connected to the paddle. A pin is slideably received within a slot in the pivot plate and moved between first and second positions in response to locking and unlocking of a locked cylinder. The actuator engages the pin in the first position so as to actuate the pivot plate and thereby open the door latch when the paddle is pulled. The actuator disengages the pin in the second position so that the paddle free floats when pulled and precludes the pivot plate from opening the door latch when the locked cylinder is locked or the power actuator is actuated.

31 Claims, 5 Drawing Sheets

DOOR LOCK ASSEMBLY WITH FREE FLOATING PADDLE

BACKGROUND OF THE INVENTION

Paddle type door lock assemblies are well known for the release of a door latching mechanism, and are commonly found on automotive, industrial, commercial and recreational vehicles. However, most paddle lock assemblies have limited application. For example, U.S. Pat No. 4,320,642 discloses a paddle handle and a single rotor latch or plunger latch assembly that utilizes a bolt that is movable between latching and unlatching positions. When the assembly is locked, the bolt moves out of contact with the handle operating arm, thereby allowing the paddle to be pivoted without operating the bolt. This assembly cannot be used for a remote latching or for electronic power locking, but can only be used in combination with an attached rotary or plunger latch. This assembly will not work with a remote single or 2-point latch.

U.S. Pat. No. 5,174,619 discloses a tailgate handle assembly with a sliding and pivoting lever, wherein the paddle handle utilizes a lever that is slideably actuated from a locked and unlocked mode by rotation of the locked cylinder or electrically via a power actuator. This invention utilizes a torsion spring to return the paddle and a U-shaped flat wire spring to return the extended lever. This invention can only be used with a single latch and latch rod, and not with a single or 2 point rotary latch or plunger bolt latch.

U.S. Pat. No. 5,941,104 discloses a paddle handle and single rotor latch assembly that utilizes an operating member that is moved out of contact position with the actuating member, thereby allowing the paddle to be pivoted without operating the actuating member. This invention does not have provisions for a remote latch or power locking, and can only be used in combination with an attached rotary latch. This invention will not work with a remote single or 2-point latch.

U.S. Pat. No. 5,058,937 discloses a flush door latch assembly that has a built-in plunger bolt or a remote single or 2-point latch, but does not have provisions for power locking.

Therefore, a primary objective of the present invention is the provision of an improved door lock assembly which can be utilized with multiple types of latches.

Another objective of the present invention is the provision of an improved door lock assembly which can be used with a single or 2-point latch, as well as a plunger bolt latch.

A further objective of the present invention is the provision of an improved door lock assembly which can be used with a remotely located latch.

Another objective of the present invention is the provision of an improved door lock assembly that can be operated mechanically or electronically with a power actuator.

Another objective of the present invention is the provision of a door lock assembly having a paddle handle which is free floating when the assembly is locked.

Another objective of the present is the provision of a door lock assembly utilizing a compression spring to normally urge a paddle handle to a closed position.

A further objective of the present invention is the provision of a door lock assembly which is economically manufactured and durable and safe in use.

These and other objectives will become apparent from the following description of the invention.

SUMMARY OF THE INVENTION

The door lock assembly of the present invention includes a housing with a paddle handle pivotally mounted in the housing for movement between a normally closed position and an open position. A plastic slide actuator is mounted on the housing and is operatively connected to the paddle for sliding linear movement between first and second positions. A pivot plate is pivotally mounted on the housing and is operatively connected to a door latch. A lock actuator is mounted in the housing and is operatively connected to the pivot plate, and is moveable between unlocked and locked positions. The slide actuator operatively engages the pivot plate when the lock actuator is in the unlocked position, whereby movement of the paddle to the open position slides the slide actuator to the second position and pivots the pivot plate to open or release door latch. The slide lock disengages the pivot plate when the lock actuator is in the locked position, whereby movement of the paddle to the open position slides the slide actuator to the second position without pivoting the pivot plate, such that the door latch is not opened.

DETAILED DESCRIPTION OF THE INVENTION

Figure 1:
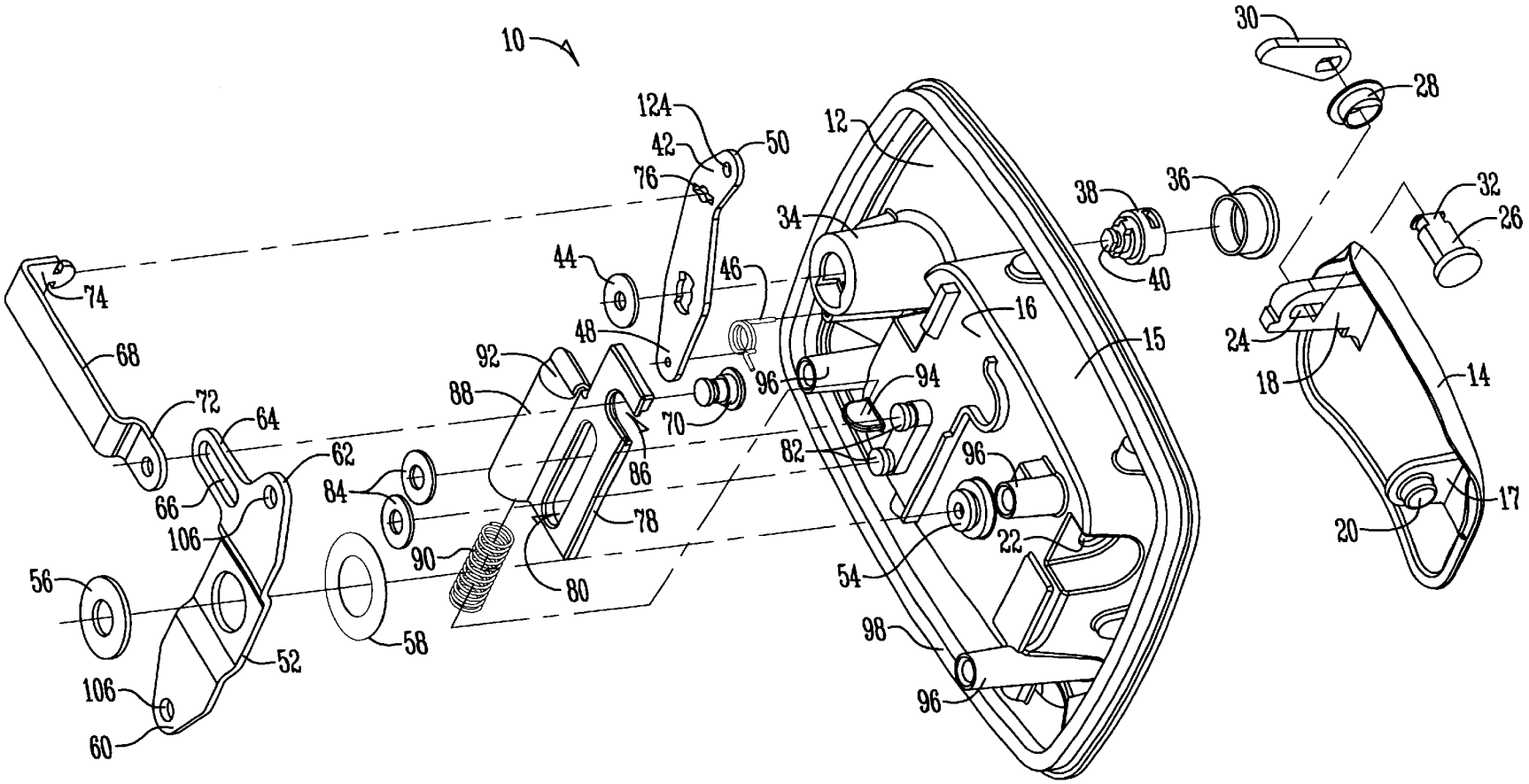
FIG. 1 is an exploded perspective view of the door lock assembly of the present invention.

An exploded view of the components of the door lock assembly of the present invention is shown in FIG. 1. The assembly includes a housing 12 with a paddle type handle 14 pivotally mounted to the housing 12. The housing 12 includes a recessed portion 13 defined by a sidewall 15 and a bottom wall 16. The paddle 14 includes a pair of legs 17, 18 for pivotally mounting the paddle to the housing 12 over the recessed portion 13. The leg 17 includes a stub shaft 20 received in an opening or recess sidewall 15 of the 22 in the housing 12. The leg 18 includes a slot 24 through which an axle 26 extends. The axle extends through a bushing 28 mounted in the leg 18 and through an arm 30. The axle 26 terminates in a T-shaped end 32 which extends through a slot (not shown) in the housing 12 with the axle 26 being rotated 90 degrees for retention by the housing. The arm 30 extends through a slot (not shown) in the bottom 16 wall of the housing 12

The housing 12 includes a recess 34 for receipt of a lock cylinder comprising a plug 36 and a mechanical actuator 38. The lower end 40 of the lock actuator 38 extends through the housing 12. A lock cam 42 is mounted on an end 40 of the lock actuator 38 and retained with a lock washer 44. A cam spring 46 is secured to a first end 48 of the lock cam 42 and to the housing 12 to normally bias the lock cam 42 to an unlocked position A pivot plate 52 is pivotally mounted on a stub axle 54 on the bottom wall 16 and retained by a lock washer 56. A low friction washer 58 may be provided between the pivot plate 52 and the axle 54. The pivot plate 52 includes opposite ends 60, 62. The second end 62 includes a leg 64 with a slot 66. The first end 60 of the pivot plate 52 is operatively connected to linkage connected to the door latch (not shown). Thus, the pivot plate is connected by linkage to the door latch, which may be a single rotor or two point rotor, or a plunger bolt latch. The linkage allows the latch to be mounted remotely from the door handle assembly 10.

A link arm 68 extends between the pivot plate 52 and the lock cam 42. More particularly, a pin or rivet 70 extends through the slot 66 in the pivot plate and through a corresponding hole in the first end 72 of the link arm 68. The opposite end of the link arm 68 has a leg 74 with a T-shaped head adapted to be received within a slot 76 in the second end 50 of the lock cam 42. By turning the link arm 68 approximately 90 degrees, the leg 74 is secured to the lock cam 42.

A slide actuator 78 is mounted on the bottom wall 16 of the housing 12. More particularly, actuator 78 includes a slot 80 through which a pair of pins 82 extending form the bottom wall 16 of the housing 12 extend. A pair of lock washers 84 are secured on the pins 82 to retain the slide actuator 78 on the housing 12 and allow sliding movement of the actuator 78 along the longitudinal axis of the slot 80. A second slot or notch 86 is provided in the actuator 78 and extends transversely to the slot 76. The slide actuator 78 also includes a semi-circular tube portion 88 adapted to house a compression spring 90. One end of 92 of the tube portion 88 is closed, while the opposite end is open. When the slide actuator 78 is mounted on the housing 12, the spring 90 is retained by the tube portion, the bottom wall 16 of the housing 12, the closed end 92 of the tube portion 88, and a tab 94 extending from the bottom wall 16.

The housing 12 includes a plurality of mounting legs 96 for mounting the assembly 10 onto a door (not shown) using screws or bolts. A sealing gasket 98 extends around the perimeter 12 to provide a moisture seal with the door when the assembly 10 is mounted.

Figure 2:
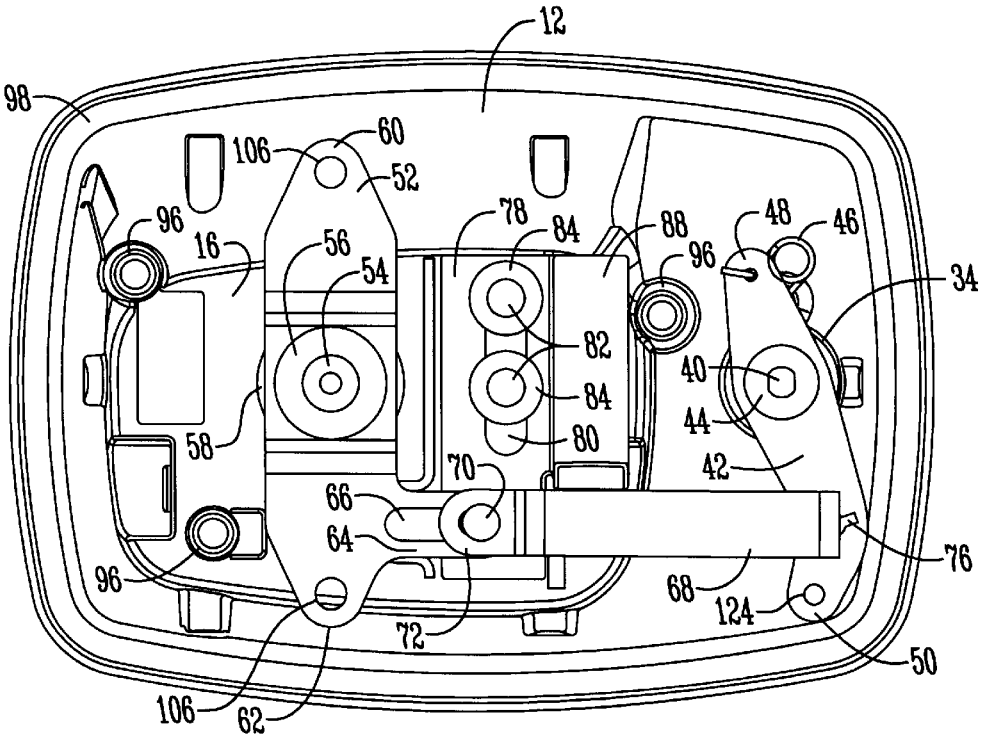
FIG. 2 is a bottom plan view of the door lock assembly in an unlocked state with the paddle handle being in the normally closed position.
Figure 4:
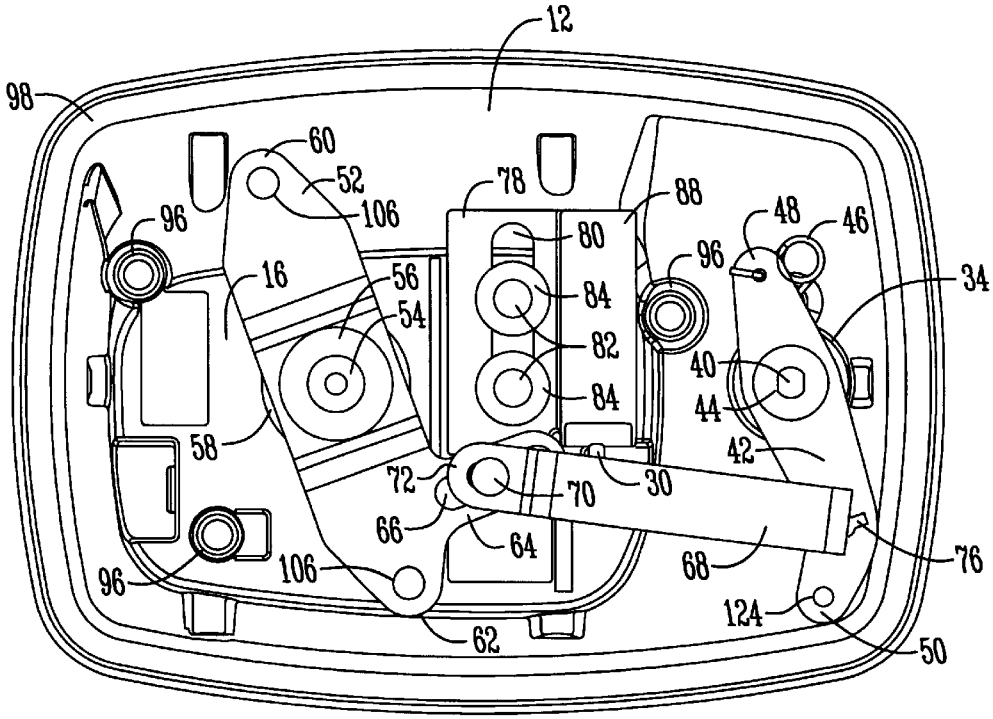
FIG. 4 is a bottom plan view of the assembly in the unlocked state, with the paddle handle pulled to an open position.

When the handle assembly 10 is in an unlocked mode, as controlled by the actuator 38 of the lock cylinder, the lock cam 42 is in the position shown in FIG. 2. When the paddle 14 is lifted or pulled to the open position, the lever arm 30, which engages the slide actuator 78, slides the slide the actuator 78 to the position shown in FIG. 4. The sliding movement of the actuator 78 is controlled by the pins 82 within the slot 80. As the slide actuator 78 moves from the first position to the second position as the paddle 14 is pulled, the actuator 78 pulls the pin or rivet 70 which extends through the transverse slot 86 of the actuator 78. Accordingly, as the slide actuator 78 moves to the second position, the pivot plate 52 and link arm 68 are also pulled to a second position via the pin 70, which slides in the slot 66 of the pivot plate 52 to the position shown in FIG. 4. As the pivot plate 52 pivots to the second position, the end 60 of the pivot plate opens the latch via the interconnecting linkage to release or open the latch so that the door can be opened.

Figure 7:
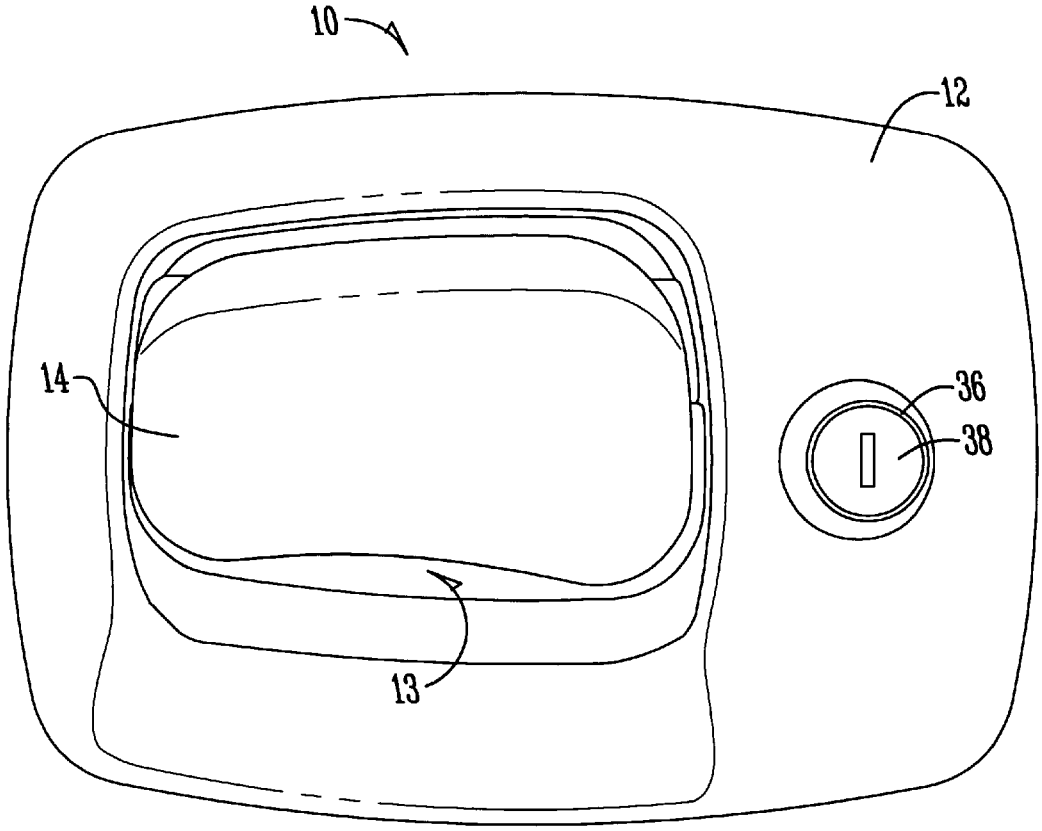
FIG. 7 is a top plan view of the door lock assembly with the paddle handle in the closed position.

The compression spring 90 housed within the tubular portion 88 of the slide actuator 78 biases the paddle 14 back to its normal closed position, as shown in FIG. 7, when the paddle is released by the user. Thus, when the paddle is released, all the moving components of the assembly 10 will automatically return to their first position as shown in FIG. 2 when the assembly 10 is in an unlocked condition.

Figure 3:
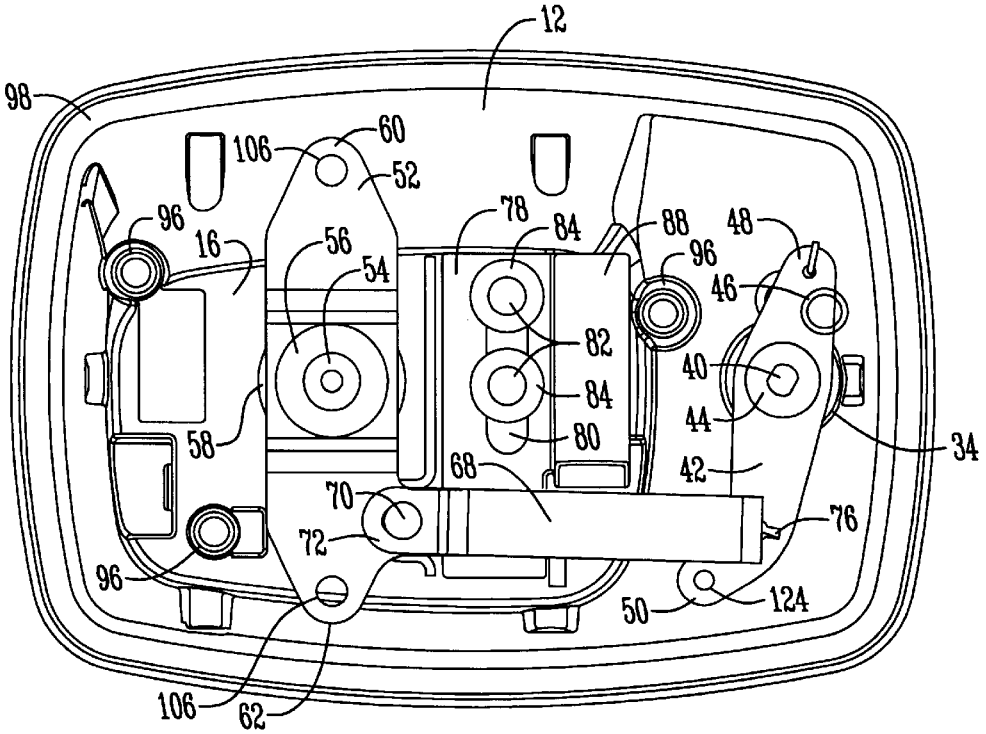
FIG. 3 is a bottom perspective view similar to FIG. 2 with the assembly being locked and the paddle handle being in the closed position.
Figure 5:
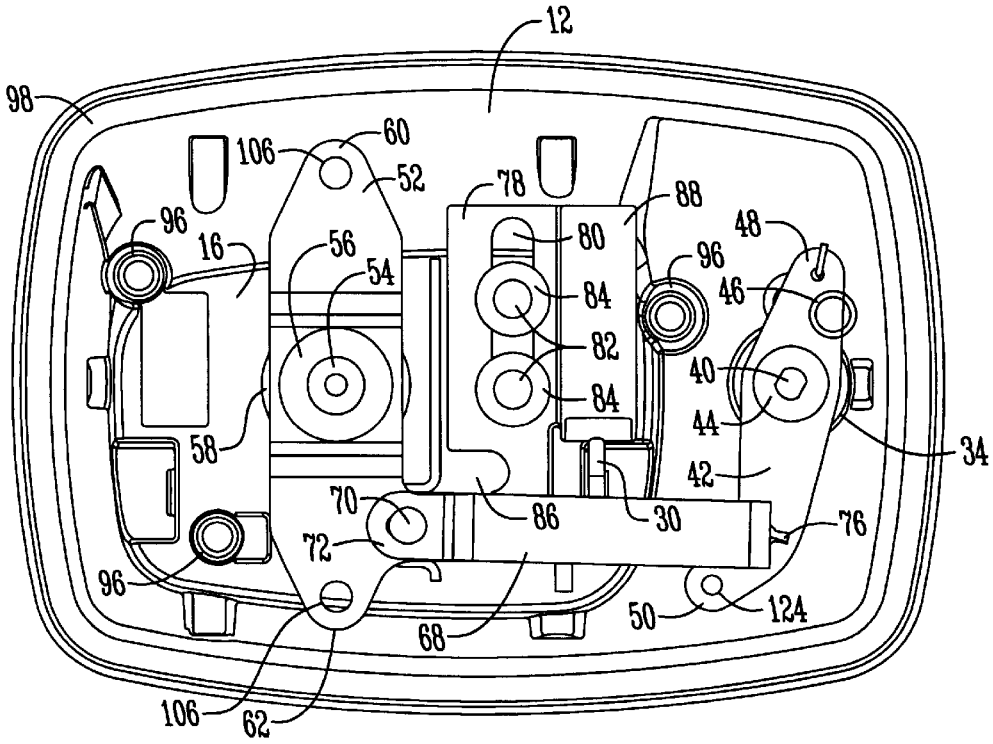
FIG. 5 is a view similar to FIG. 4 showing the assembly in a locked condition, with the paddle handle pulled to an open position.
Figure 6:
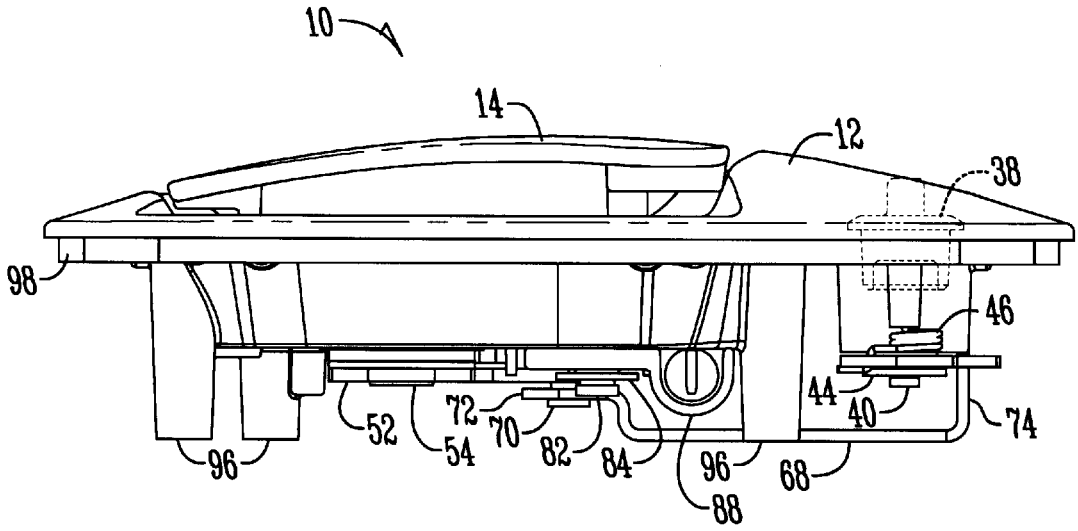
FIG. 6 is a side elevation view of the door lock assembly in an unlocked condition, with the paddle handle in the normally closed position.

When a key is used to lock the assembly 10, the lock cylinder actuator 38 pivots the lock cam 42 to the position shown in FIG. 3. If a power lock actuator is used to lock the assembly 10, the push-pull motion of the actuator is connected to the hole 124 of lock cam 42 with an actuator rod 118, as described below. This push-pull motion pivots the lock cam 42 to the position shown in FIG. 3. Either of these pivotal movements to the lock cam 42 moves the connecting link 68 and pin 70 to the opposite end of the slot 66 of the pivot plate 52, as seen in FIG. 3. The pin 70 is then disengaged from the slot 86 of the slide actuator 78. Thus, when the paddle 14 is pulled to an open position by a user, the arm 30 slides to slide the actuator 78 to the position shown in FIG. 5, but since the pin 70 is not engaged with the slide actuator 78, the pivot plate 52 and connecting link 68 remain stationary, so that there is no action by the pivot plate 52 on the door latch. Accordingly, the paddle 14 free floats when the assembly 10 is in a locked condition. Upon release of the paddle 14, the compression spring 90 returns the slide actuator 78 and the paddle 14 to their first positions, as shown in FIG. 3.

With the assembly 10 of the present invention, the pivot plate 52 can be connected through linkage to various types of latches, including a single or 2-point latch, and a plunger bolt latch. Thus, the construction of the assembly 10 makes the assembly more versatile and useful in different applications.

Figure 8:
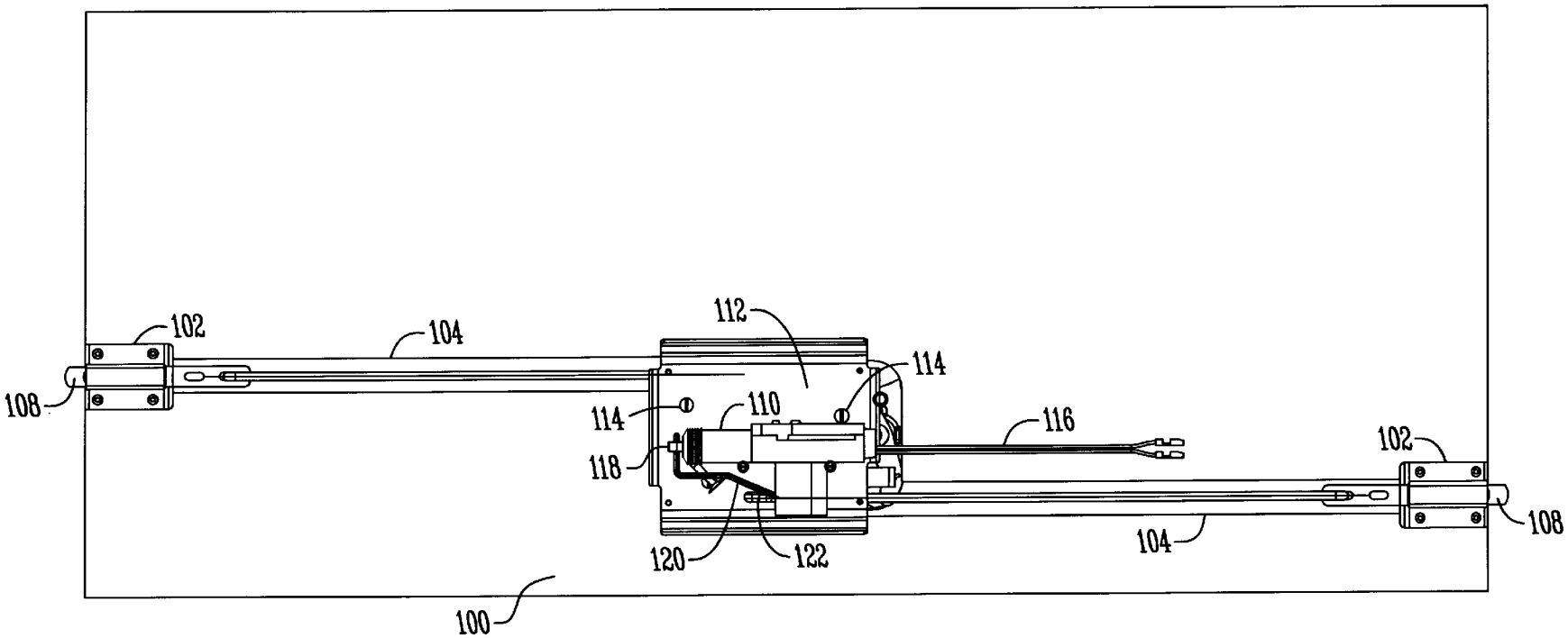
FIG. 8 is an elevation view showing the door lock assembly of the present invention mounted on a door having a 2-point plunger type latch and an electrically operated power actuator.

FIG. 8 shows the door lock assembly 10 mounted on a door 100 having a plunger bolt assembly 102 located on opposite sides of the door 100. Each plunger bolt assembly 102 has a release rod 104 extending therefrom with the inner ends of the release rods 104 extending through holes 106 in the opposite ends of the pivot plate 52. Thus, when the pivot plate 52 is pivoted to the position shown in FIG. 4, the release rods 104 unlatch the plunger bolts 108 so that the door 100 can be opened.

FIG. 8 also shows a power actuator 110 operatively connected to the lock assembly 10. More particularly, the power actuator 110 is mounted on a mounting bracket 112. The lock assembly 10 is also secured to the mounting bracket 112 by self tapping screws or fasteners 114 which thread into the mounting legs 96. Electrical leads 116 extend from the power actuator 110 and are connected to a power source, such as a battery of the vehicle. The power actuator includes a latch rod 118 to which one end of a power actuator rod 120 is connected. The opposite end of the actuator rod 120 extends through a slot 122 in the mounting bracket 12 and into a hole 124 in the lock cam 42. The power actuator 110 moves the latch rod 118 inwardly and outwardly (left and right in FIG. 8) so that the power actuator rod 120 moves the lock cam 42 between the unlocked and locked positions shown in FIGS. 2 and 3, respectively, in response to an electrical switch or receipt of a signal by the power actuator 110 from a transmitter. Thus, the lock assembly 10 can be controlled by remote transmitter, for example on the user's key ring.

While FIG. 8 shows the lock assembly 10 used on a 2-point latch assembly, it is understood that the lock assembly 10 can be used on a single point latch assembly using a single actuator rod connected to one of the holes 106 in the pivot plate 52. Also, the latch assemblies may be rotor type latches, as opposed to the plunger bolts 108 shown in FIG. 8.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A door lock assembly, comprising:

a housing;

a paddle pivoting mounted on the housing for movement between a normally closed position and an open position;

a slide actuator mounted on the housing and being operatively connected to the paddle for movement between first and second positions;

a pivot plate pivotally mounted on the housing and being operatively connected to a door latch;

a lock actuator operatively connected to the pivot plate, the lock actuator being movable between unlocked and locked positions;

the slide actuator operatively engaging the pivot plate when the lock actuator is in the unlocked position whereby movement of the paddle to the open position slides the slide actuator to the second position and pivots the pivot plate to release the door latch; and the slide actuator disengaging the pivot plate when the lock actuator is in the locked position whereby movement of the paddle to the open position slides the slide actuator to the second position without pivoting the pivot plate such that the door latch is not opened.

2. The door lock assembly of claim 1 further comprising a spring acting on the slide actuator to normally urge the slide actuator to the first position and to normally urge the paddle to the closed position.

3. The door lock assembly of claim 2 wherein the spring is a compression spring.

4. The door lock assembly of claim 2 wherein the slide actuator includes a channel for capturing the spring.

5. The door lock assembly of claim 1 further comprising a lock cam connected to the lock actuator and being operatively connected to the pivot plate.

6. The door lock assembly of claim 5 further comprising a link arm extending between the lock cam and the pivot plate.

7. The door lock assembly of claim 6 wherein the link arm has a first end connected to the lock cam and a second end connected to the pivot plate.

8. The door lock assembly of claim 7 wherein the first end of the link arm extends through a slot in the lock cam and is turned 90° to retain the first end in the lock cam.

9. The door lock assembly of claim 7 wherein the second end of the link arm is connected to the pivot plate by a pin.

10. The door lock assembly of claim 9 wherein the pivot plate includes a slot through which the pin extends whereby the pin moves along the slot when the lock cam is pivoted in response to movement of the lock actuator between the locked and unlocked positions.

11. The door lock assembly of claim 9 wherein the slide actuator engages and disengages the pin when the lock actuator is unlocked and locked, respectively.

12. The door lock assembly of claim 1 further comprising an arm is connected to the paddle and engaging the slide actuator to move the slide actuator to the second position when the paddle is moved to the open position.

13. The door lock assembly of claim 1 wherein the paddle free floats when the lock actuator is in the locked position.

14. The door lock assembly of claim 1 wherein the lock actuator is a mechanical actuator.

15. The door lock assembly of claim 1 wherein the lock actuator is a power actuator.

16. A door lock assembly for use with a door latch, comprising:

a housing having opposite front and rear sides;

a paddle pivotally mounted on the front side of the housing for movement between open and closed positions;

a lock actuator moveable between unlocked and locked positions;

a lock cam connected to the lock actuator for movement between locked and unlocked positions;

a link arm having first and second ends, with the first end connected to the lock cam;

a pivot plate pivotally mounted on the housing and being connected to the second end of the link arm;

a slide actuator slidably mounted on the housing and being operatively connected to the paddle, the slide actuator being operatively engageable with the pivot plate when the lock actuator is in the unlocked position whereby upon pivoting the paddle to the open position the slide actuator will move the pivot plate to release the door latch, and the slide actuator disengaging the pivot plate when the lock actuator is in the locked position whereby upon pivoting the paddle to the open position the slide actuator does not move the pivot plate and thereby precludes release of the latch.

17. The door latch assembly of claim 16 further comprising an arm connected to the paddle and engaging the slide actuator to move the latch actuator to an operative position upon moving the paddle to the open position.

18. The door lock assembly of claim 16 further comprising a spring to normally urge the paddle to the closed position.

19. The door lock assembly of claim 16 wherein the link arm has a first end received in a slot in the lock cam and the link arm being rotated 90° to retain the first end in the lock cam slot.

20. The door lock assembly of claim 16 wherein the link arm has a second end connected to the pivot plate by a pin, the slide actuator engaging the pin when the lock actuator is in the unlocked position, and the slide actuator disengaging the pin when the lock actuator is in the locked position.

21. The door lock assembly of claim 20 wherein the pivot plate includes a slot for receiving the pin, the pin sliding in the slot between a first position engaging the slide actuator and a second position disengaging the slide actuator.

22. The door lock assembly of claim 16 wherein the slide actuator is plastic.

23. The door lock assembly of claim 16 wherein the lock actuator is a mechanical actuator operated with a key.

24. The door lock assembly of claim 16 wherein the lock actuator is a power actuator that is powered electrically.

25. A door lock assembly comprising:

a housing;

a paddle pivotally mounted on the housing;

a pivot plate pivotally mounted on the housing and being operatively connected to a door latch, the pivot plate having a slot therein;

an actuator mounted on the housing and being operatively connected to the paddle;

a pin slidably received in the pivot plate slot and being movable between first and second positions within the slot;

the actuator engaging the pin in the first position so as to actuate the pivot plate to open the door latch when the paddle is pulled; and the actuator disengaging the pin in the second position so that the paddle free floats when pulled and preclude the pivot plate from opening the door latch.

26. The door lock assembly of claim 25 further comprising a lock actuator operatively connected to the pin, the lock actuator being movable between unlocked and locked positions and sliding the pin within the pivot plate slot between the first and second positions.

27. The door lock assembly of claim 25 further comprising a link arm having a first end operatively connected to the lock actuator and a second end connected to the pin.

28. The door lock assembly of claim 26 wherein the lock actuator is mechanically operated.

29. The door lock assembly of claim 26 wherein the lock actuator is operated by a remote power source.

30. The door lock assembly of claim 25 further comprising a spring to normally urge the paddle to a closed position.

31. The door lock assembly of claim 25 wherein the actuator slides between first and second positions in response to movement of the paddle between closed and open positions.

* * * * *